US011933114B2

(12) United States Patent
Benoist et al.

(10) Patent No.: US 11,933,114 B2
(45) Date of Patent: Mar. 19, 2024

(54) SYSTEMS FOR SECURING A DOWNHOLE TOOL TO A HOUSING

(71) Applicant: Schlumberger Technology Corporation, Sugar Land, TX (US)

(72) Inventors: Xavier Benoist, Cheltenham (GB); Nicolas Mornet, Bristol (GB)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 106 days.

(21) Appl. No.: 17/754,602

(22) PCT Filed: Oct. 8, 2020

(86) PCT No.: PCT/US2020/054723

§ 371 (c)(1),
(2) Date: Apr. 7, 2022

(87) PCT Pub. No.: WO2021/072038

PCT Pub. Date: Apr. 15, 2021

(65) Prior Publication Data

US 2023/0024643 A1 Jan. 26, 2023

Related U.S. Application Data

(60) Provisional application No. 62/912,686, filed on Oct. 9, 2019.

(51) Int. Cl.
*E21B 17/10* (2006.01)

(52) U.S. Cl.
CPC ..... *E21B 17/1078* (2013.01)

(58) Field of Classification Search
CPC ..... E21B 17/1078; E21B 47/017
See application file for complete search history.

(56) References Cited

U.S. PATENT DOCUMENTS

| | | | | |
|---|---|---|---|---|
| 10,113,412 | B2 | 10/2018 | Logan et al. | |
| 2003/0070803 | A1* | 4/2003 | Gremillion | E21B 17/1078 166/241.6 |
| 2008/0314585 | A1 | 12/2008 | Clark | |
| 2010/0175888 | A1* | 7/2010 | Buytaert | E21B 41/00 166/381 |
| 2014/0182839 | A1* | 7/2014 | McDaniel | E21B 17/1064 166/243 |

FOREIGN PATENT DOCUMENTS

| | | | |
|---|---|---|---|
| EP | 2586961 | A2 | 5/2013 |
| WO | 2015171402 | A1 | 11/2015 |
| WO | 2015175296 | A1 | 11/2015 |

OTHER PUBLICATIONS

International Search Report and Written Opinion in International Patent Application No. PCT/US2020/054723, dated Mar. 17, 2021, 9 pages.

* cited by examiner

*Primary Examiner* — D. Andrews
*Assistant Examiner* — Ronald R Runyan
(74) *Attorney, Agent, or Firm* — Jeffrey D. Frantz

(57) ABSTRACT

A system for securing a downhole tool to a housing includes a plurality of linear wave springs placed around a chassis. The linear wave strings have an unstressed height that is less than or equal to an annular gap. This reduces the insertion force required to insert the chassis into the housing. The linear wave springs are compressed to increase the amount of radial force applied to the chassis and the housing.

19 Claims, 10 Drawing Sheets

SYSTEMS FOR SECURING A DOWNHOLE TOOL TO A HOUSING

CROSS-REFERENCE TO RELATED APPLICATIONS

This application is the National Stage Entry of International Application No. PCT/US2020/054723, filed Oct. 8, 2020, claims the benefit of U.S. provisional application No. 62/912,686 entitled "Systems For Securing A Downhole Tool To A Housing" filed Oct. 9, 2019, the disclosure of which is incorporated herein by reference.

BACKGROUND

Downhole tools are used during underground drilling applications for a variety of applications. Some downhole tools include sensors, processors, communication devices, pumps, motors, expandable tools, and so forth. The downhole tools are often located on a chassis inserted into a housing. During a drilling operation, shocks, vibrations, and other loads are transferred from a bit and other areas of a downhole drilling system to the housing. The shock and vibration are transmitted to the chassis through the housing. The mechanism for securing the downhole tools to the housing determines how the shock, vibration, and other loads are transmitted to the downhole tool, which may affect the performance and operational lifetime of the downhole tool.

SUMMARY

In some embodiments, a system for stabilizing a downhole tool includes a housing having a bore therethrough. A chassis has at least one linear wave spring arranged around an outer circumference of the chassis. The linear wave spring is supported on a first end by a support member. In a first configuration, the chassis is located outside of the housing. In a second configuration, the chassis is inserted into the housing. In a third configuration, a compression member at a second end of the linear wave spring applies a compressive force to the linear wave spring.

In other embodiments, a system for stabilizing a downhole tool includes a housing having a bore therethrough. A chassis has a plurality of linear wave springs arranged around an outer circumference of the chassis. The plurality of linear wave springs include a stressed state and an unstressed state. In a first configuration, the chassis and the plurality of linear wave springs are located outside of the housing and in the unstressed state. In a second configuration, the chassis and the plurality of linear wave springs are located inside the housing and in the unstressed state. In a third configuration, the plurality of linear wave springs are placed in a stressed state, and in the stressed state, the plurality of linear wave springs push on both the housing and the chassis.

In yet other embodiments, a method for securing a downhole tool includes placing a plurality of linear wave springs around a chassis. The chassis is inserted into a housing, and a compressive force parallel to a longitudinal axis of the housing is applied to the plurality of linear wave springs.

This summary is provided to introduce a selection of concepts that are further described in the detailed description. This summary is not intended to identify key or essential features of the claimed subject matter, nor is it intended to be used as an aid in limiting the scope of the claimed subject matter. Additional features and aspects of embodiments of the disclosure will be set forth herein, and in part will be obvious from the description, or may be learned by the practice of such embodiments.

BRIEF DESCRIPTION OF THE DRAWINGS

In order to describe the manner in which the above-recited and other features of the disclosure can be obtained, a more particular description will be rendered by reference to specific embodiments thereof which are illustrated in the appended drawings. For better understanding, the like elements have been designated by like reference numbers throughout the various accompanying figures. While some of the drawings may be schematic or exaggerated representations of concepts, at least some of the drawings may be drawn to scale. Understanding that the drawings depict some example embodiments, the embodiments will be described and explained with additional specificity and detail through the use of the accompanying drawings in which:

FIG. 3-1 is a schematic representation of a downhole tool stabilization system in a transition between a first configuration and a second configuration, according to at least one embodiment of the present disclosure;

FIG. 3-2 is a schematic representation of the downhole tool stabilization system of FIG. 3-1 in the second and third configuration, according to at least one embodiment of the present disclosure;

FIG. 4-1 is a cross-sectional view of a representation of a downhole tool stabilization system, according to at least one embodiment of the present disclosure;

FIG. 4-2 is another cross-sectional view of the downhole tool stabilization system of FIG. 4-1;

FIG. 4-3 is still another cross-sectional view of the downhole tool stabilization system of FIG. 4-1;

DETAILED DESCRIPTION

Figure 1:
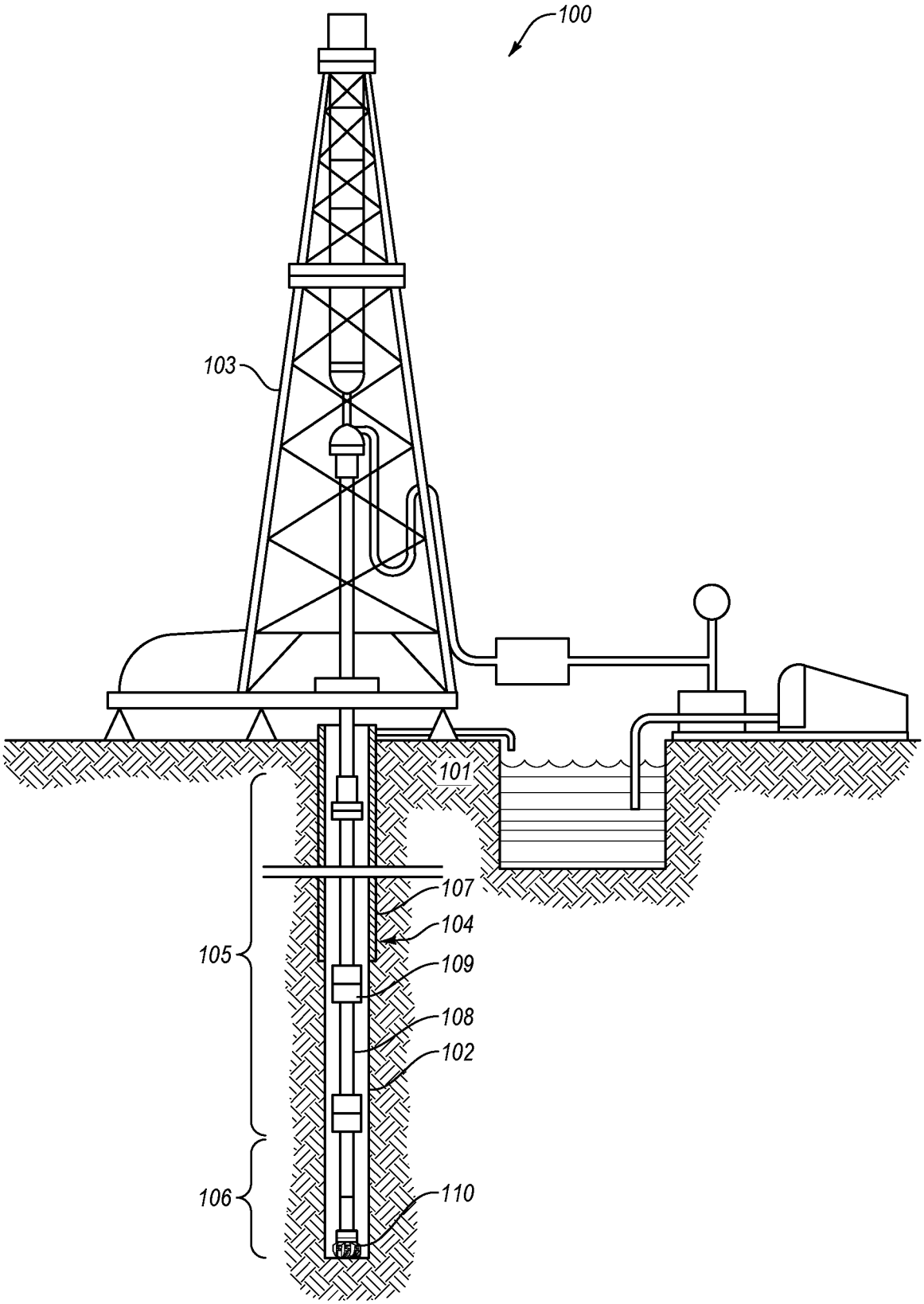
FIG. 1 is a representation of a downhole drilling system, according to at least one embodiment of the present disclosure.

This disclosure generally relates to devices, systems, and methods for securing a downhole tool to a housing. Downhole tools may be located in a housing. The housing may protect the downhole tool from damage from impact with other downhole elements, shock, vibration, drilling fluid, and may connect the downhole tool to other downhole tools, the remainder of the drill string, or the bit. The downhole tool may be located on a chassis, and the chassis inserted into a bore of the housing. The chassis may be supported in the bore of the housing with one or more resilient members, such as linear wave springs. Conventionally, the linear wave spring has an unstressed height that is greater than an annular gap between the housing and the chassis. Therefore, when the chassis is inserted into the bore of the housing, the stressed height of the linear wave spring when inserted into the housing is less than the unstressed height. In this manner, the linear wave spring may push radially against the housing and the chassis, which may secure the chassis to the housing and provide some degree of vibration and shock protection to the chassis.

To install the conventional chassis, and therefore compress the height of the linear wave springs, the chassis is inserted into the bore of the housing with an insertion force parallel to a longitudinal axis of the housing and the chassis. Compressing the height of the linear wave spring may increase the length of the linear wave spring as the height of the linear wave spring is reduced. The longitudinal insertion force required to insert the chassis and compress the linear wave springs is quite large and may require specialized equipment. Similarly, a high removal force is required to remove the chassis and the downhole tool. A high longitudinal insertion/removal force makes accessing the downhole tool in the conventional chassis (such as for servicing or data retrieval) time consuming and expensive.

A linear wave spring with an unstressed height that is approximately the same as or less than the annular gap between the housing and the chassis may allow the chassis to be installed with a significantly lower insertion force. This may make inserting and removing the chassis and the downhole tool significantly easier, while providing the same or better support for the chassis and/or the downhole tool. Easier access to the chassis and the downhole tool may allow the downhole tool to be accessed and/or serviced in the field at the job site. This may save time and money for the downhole drilling operation.

To secure the chassis to the housing, once the chassis is inserted, the linear wave springs may be longitudinally compressed using a compression member. In an unconfined environment, longitudinal compression of the linear wave springs may cause the linear wave springs to reduce in length. Reducing the length of the linear wave springs may cause buckling, or at least one of the waves of the linear wave springs to increase in amplitude (e.g., height). In the confined environment of the annulus between the housing and the chassis, this may cause the peak of the linear wave spring to push against the housing and the valley of the linear wave spring to push against the chassis with a greater radial force. By compressing the linear wave springs, greater radial pressures against the housing and the chassis may be achieved.

The downhole tool may be located in the chassis. In some embodiments, the downhole tool may include one or more electronics boards. For example, the electronics boards may include one or more sensors, one or more processors, communication devices, other electronic equipment, and combinations of the foregoing. In some embodiments, the downhole tool may include other downhole tools and components, such as an MWD, an LWD, a mud pulse generator, a downhole power generator, an RSS, an expandable tool, other downhole tools, and combinations of the foregoing.

In some embodiments, the chassis may include a first (e.g., top) chassis portion and a second (e.g., bottom) chassis portion. The plurality of linear wave springs are arranged around an outer circumference of the chassis. In some embodiments, the chassis may include one or more wave spring slots, and at least one linear wave spring may be inserted into the wave spring slots. In some embodiments, each linear wave spring may be inserted into a wave spring slot. In some embodiments, the linear wave springs may be evenly spaced around the chassis. The chassis may be compressed against the housing by the combined inward radial forces from opposing linear wave springs. The outward radial force applied to the housing and the inward radial force applied to the chassis may be equal or approximately equal around an outer circumference of the chassis and an inner circumference of the housing, thereby securing the chassis to the housing. A high radial force between the chassis and the housing may improve the transmissibility of shock and vibration between the housing and the chassis. Improved transmissibility of shock and vibration may reduce resonant vibration, vibration of the chassis relative to the housing, movement of the chassis relative to the housing, and combinations of the foregoing. This may improve the operational lifetime and/or performance of the downhole tool, thereby saving the operator time and money by reducing the amount of replacements required.

In some embodiments, the chassis and the housing may be cylindrical, or have a circular transverse cross section. In some embodiments, one or both of the chassis and the housing may be non-cylindrical. For example, one or both of the chassis and the housing may have a square or rectangular transverse cross-section. In other examples, one or both of the chassis and the housing may have a transverse cross-section that is any shape, including triangular, pentagonal, hexagonal, heptagonal, octagonal, 9-sided, 10-sided, or any other shape. A non-cylindrical chassis and/or housing may be used when the structure of the downhole tool requires a non-cylindrical tool.

In some embodiments, the linear wave springs are supported by a support member. The support member may be connected to the linear wave springs at a first end (e.g., an uphole end). The support member may include a ring with a slot around the rim. The first end of each linear wave spring may be inserted into the slot. In some embodiments, the support member may be connected to the chassis. For example, the support member may be threaded onto the chassis, welded to the chassis, connected with a mechanical fastener, connected with another connection, and combinations of the foregoing. In some embodiments, the support member may be connected to the housing. For example, the support member may be threaded into the housing, welded to the housing, connected to the housing with a mechanical fastener, and combinations of the foregoing. In some embodiments, the support member may be connected to both the chassis and the housing. By securing the support member to the housing, a longitudinally compressive force may be applied to the linear wave springs, and the support member may prevent the linear wave springs from longitudinal movement relative to the housing.

In some embodiments, a system for securing a downhole tool to a housing includes at least three configurations. In a first configuration, the chassis is located outside of the housing. The linear wave springs are placed around the chassis and are in an unstressed state. In the unstressed state, the linear wave springs have an unstressed height. This means that the linear wave springs are not placed under tension, compression, or otherwise have any outside forces applied to them.

The housing has a housing internal diameter, and the chassis has a chassis external diameter. Half of the difference between the housing internal diameter and the chassis external diameter is an annular gap. In some embodiments, the unstressed height of the linear wave springs is less than or equal to the linear gap. In some embodiments, the unstressed height of the linear wave springs is approximately the same as the linear gap. In some embodiments, the unstressed height is slightly larger than the annular gap. In some embodiments, the unstressed height is an unstressed height percentage of the annular gap. In some embodiments, the unstressed height percentage may be in a range having a lower value, an upper value, or lower and upper values including any of 50%, 75%, 80%, 85%, 90%, 92.5%, 95%, 97.5%, 98%, 99%, 100%, 100.5%, 101%, 101.5%, 102%, 103%, 104%, 105%, 110%, 115%, 120%, 130%, 140%, 150%, or any value therebetween. For example, the unstressed height percentage may be greater than 50%. In another example, the unstressed height percentage may be less than 150%. In yet other examples, the unstressed height percentage may be any value in a range between 50% and 150%. In some embodiments, it may be critical that the unstressed height percentage is 100% or less to enable smooth installation of the chassis into the housing.

In the second configuration, the chassis is inserted into the housing. During insertion into the housing, the linear wave springs remain unstressed. This means that the linear wave springs are neither compressed or elongated transversely (e.g., radially) or longitudinally. In other words, a transition between the first configuration and the second configuration, does not apply any radial compressive forces on the linear wave springs. For example, the height of the linear wave spring is the same in the first configuration as in the second configuration. Similarly, the length of the linear wave spring is the same in the first configuration as in the second configuration. Thus, the only force required to insert the chassis into the housing to move between the first configuration and the second configuration is the force required to move the mass of the chassis and attached components longitudinally into the housing. This may allow for easy, simple, and fast installation of the chassis into the housing. In this manner, the chassis, and the associated downhole tool, may be accessed in the field. This may save the operator time and money during the downhole drilling operation. In some embodiments, where the linear wave springs have an unstressed height greater than the annular gap, some force may be required to insert the chassis. In such embodiments, the stressed state of the linear wave springs may not be sufficient to rigidly secure the chassis to the housing. Furthermore, in such embodiments, installation of the chassis into the housing may be relatively easy, simple, and fast, as compared to conventional systems.

In the third configuration, the chassis is secured to the housing by applying a compressive force to the linear wave springs, thereby placing the linear wave springs into a compressed state. Applying a compressive force to the linear wave springs may cause the linear wave springs to reduce in length (i.e., compress) and push (i.e., exert a radial pressure) on the chassis and the housing. Thus, in the third configuration, and in the stressed state, the length of the linear wave spring may be less than the length of the linear wave spring in the first configuration and the second configuration, or the unstressed state. Similarly, if the height of the linear wave spring in the first and second configurations, or the unstressed state, is less than the annular gap between the chassis and the housing, the height of the linear wave springs in the third configuration may be greater than the height of the linear wave springs in the first and second configurations, or the stressed state.

In some embodiments, a compression member may apply the longitudinal (e.g., compressive) force to the plurality of linear wave springs. In some embodiments, the compressive force is parallel to a longitudinal axis of the housing. In some embodiments, the compression member may include a compression ring. The compression ring may include a compression ring slot into which a second end of the linear wave springs is inserted. In some embodiments, the compression ring may be threaded into the housing. As the compression ring is threaded into the housing, the compression ring may travel along the length of the housing. When the support member is fixed relative to the housing, the linear wave springs may be compressed as the compression ring is moved relative to the housing. In some embodiments, the compression ring may move relative to the housing with a piston. For example, a hydraulic piston may push against the compression ring to compress the linear wave springs.

In some embodiments, the compression member may include a compression plate at the second end of the linear wave springs. The support member may include a support plate at the first end of the linear wave springs. One or more compression rods may extend between the support plate and the compression plate. In some embodiments, the compression rods may include a mechanical fastener, such as a nut. When the nut is threaded onto the compression rods, the nut may force the compression plate toward the support plate, thereby applying a compressive force to the linear wave springs.

In some embodiments, the compression rods may be made of a shape-memory alloy. The downhole tool support system may be installed at a heated temperature, and the shape-memory alloy compression rods may have a first shape with a first length at the heated temperature. When the temperature is reduced, the shape-memory compression rods may change to a second shape, with a second length. The second length may be less than the first length. Thus, when the temperature is reduced, the shape-memory alloy compression rods may compress the linear wave springs between the compression member and the support member.

As the linear wave spring is compressed in the third configuration by the compression member, the length of the linear wave springs may be decreased. In some embodiments, the compression member may move longitudinally toward the chassis to compress the linear wave springs. Because the support member is fixed to the housing, as the compression member moves toward the chassis, the linear wave springs are compressed. In some embodiments, in the second configuration, a compression gap exists between the chassis and the compression member. As the compression member is moved toward the chassis, the compression gap may be reduced. In some embodiments, the compression member may be moved to the chassis so that the compression member contacts the chassis (e.g., the compression gap is reduced to zero). In some embodiments, the compression member may be moved toward the chassis so that the compression gap is only partially closed. Thus, by changing the amount of the compression gap that is closed, the amount of compressive force on the linear wave springs, and therefore the amount of radial force applied to the chassis and the housing, may be adjusted. This may allow the operator to tailor or optimize the radial force connecting the chassis to the housing, thereby helping to improve operational lifetime of the downhole tool.

In some embodiments, the length of the linear wave spring may be decreased by a length reduction. In some embodiments, the length reduction may be in a range having a lower value, an upper value, or lower and upper values including any of 0.5 millimeters (mm), 1.0 mm, 1.5 mm, 2.0 mm, 2.5 mm, 3.0 mm, 3.5 mm, 4 mm, 5 mm, 6 mm, 7 mm, 8 mm, 9 mm, 10 mm, or any value therebetween. For example, the length reduction may be greater than 0.5 mm. In another example, the length reduction may be less than 10 mm. In yet other examples, the length reduction may be any value in a range between 0.5 mm and 10 mm. In some embodiments, it may be critical that the length reduction is greater than 2 mm to ensure a sufficient radial force between the housing and the chassis.

The length of the linear wave spring may be reduced by a length reduction percentage when compressed by the compression member, which is a percentage of the length reduction relative based on the linear wave spring length. In some embodiments, the length reduction percentage may be in a range having a lower value, an upper value, or lower and upper values including any of 0.5%, 1%, 2%, 3%, 4%, 5%, 6%, 7%, 8%, 9%, 10%, 15%, 20%, or any value therebetween. For example, the length reduction percentage may be greater than 0.5%. In another example, the length reduction percentage may be less than 20%. In yet other examples, the length reduction percentage may be any value in a range between 0.5% and 20%. In some embodiments, it may be critical that the length reduction percentage is greater than 5% to ensure a sufficient radial force between the housing and the chassis.

In some embodiments, the compression force applied to the linear wave spring by the compression member in the third configuration may be in a range having a lower value, an upper value, or lower and upper values including any of 1 kilonewtons (kN), 2 kN, 3 kN, 4 kN, 5 kN, 6 kN, 7 kN, 8 kN, 9 kN, 10 kN, 12 kN, 14 kN, 15 kN, 17.5 kN, 20 kN, or any value therebetween. For example, the compression force may be greater than 1 kN. In another example, the compression force may be less than 20 kN. In yet other examples, the compression force may be any value in a range between 1 kN and 20 kN. In some embodiments, it may be critical that the compression force is greater than 7 kN to ensure that a sufficient radial force is applied to the housing and the chassis.

Compressing the linear wave springs results in an inward radial force against the chassis and an outward radial force against the housing for each linear wave spring. In some embodiments, the magnitude of the radial force may be in a range having a lower value, an upper value, or lower and upper values including any of 0.5 kN, 1.0 kN, 1.5 kN, 2.0 kN, 2.5 kN, 3.0 kN, 4.0 kN, 5.0 kN, 6.0 kN, 7.0 kN, 8.0 kN, 9.0 kN, 10 kN, 15 kN, 20 kN, or any value therebetween. For example, the radial force may be greater than 0.5 kN. In another example, the radial force may be less than 20 kN. In yet other examples, the radial force may be any value in a range between 0.5 kN and 20 kN. In some embodiments, it may be critical that the radial force is greater than 5 kN to properly secure the chassis and protect it from shock and vibration damage.

The plurality of linear wave springs may include any number of linear wave springs, including, 2, 3, 4, 5, 6, 7, 8, 9, 10, or more linear wave springs. In some embodiments, the plurality of linear wave springs have a combined radial force on the housing and the chassis. This is the sum of radial forces applied by the plurality of linear wave springs. In some embodiments, the combined radial force may be in a range including any of 1.0 kN, 2.0 kN, 2.5 kN, 5.0 kN, 6.0 kN, 7.0 kN, 8.0 kN, 9.0 kN, 10 kN, 15 kN, 20 kN, 30 kN, 40 kN, 50 kN, 75 kN, 100 kN, 150 kN, 200 kN, or any value therebetween. For example, the combined radial force may be greater than 1.0 kN. In another example, the combined radial force may be less than 200 kN. In yet other examples, the combined radial force may be any value in a range between 1.0 kN and 200 kN. In some embodiments, it may be critical that the combined radial force is greater than 10 kN to properly secure the chassis and protect it from shock and vibration damage.

The combined radial force has a force ratio with the compressive force. In some embodiments, the force ratio may be in a range having a lower value, an upper value, or lower and upper values including any of 5:1, 4:1, 3:1, 2:1, 1:1, 1:2, 1:3, 1:4, 1:5, or any value therebetween. For example, the force ratio may be greater than 5:1. In another example, the force ratio may be less than 1:5. In yet other examples, the force ratio may be any value in a range between 5:1 and 1:5. In some embodiments it may be critical that the force ratio is greater than 3:1 to properly secure the chassis and protect it from shock and vibration damage.

In some embodiments, a method for securing a downhole tool includes placing a plurality of wave springs around a chassis. The chassis may be inserted into the housing. Inserting the chassis into the housing may include inserting the chassis with an insertion force. In some embodiments, the insertion force may be in a range having a lower value, an upper value, or lower and upper values including any of 1 Newtons (N), 50 N, 100 N, 150 N, 200 N, 250 N, 300 N, 350 N, 400 N, 450 N, 500 N, 600 N, 700 N, 800 N, 900 N, 1,000 N, or any value therebetween. For example, the insertion force may be greater than 1 N. In another example, the insertion force may be less than 1,000 N. In yet other examples, the insertion force may be any value in a range between 1 N and 1,000 N. In some examples the insertion force may be the force required to move the combined mass of the chassis, the downhole tool, and the linear wave springs longitudinally into the housing. In some examples, the insertion force may include the force required to move the combined mass plus any friction forces required to slide the chassis along the housing. In some examples, the insertion force may not include the force required to radially compress one or more of the linear wave springs.

A compressive force may be applied on the plurality of wave springs. The compressive force may be parallel to the longitudinal axis of the housing. Applying the compressive force may include causing the plurality of wave springs to apply a radial force to the housing. Furthermore, applying the compressive force may include threading a compression member into the housing. In some embodiments, applying the compressive force may include reducing the length of the plurality of wave springs by at least 3 mm.

Referring now to the figures, FIG. 1 shows one example of a drilling system 100 for drilling an earth formation 101 to form a wellbore 102. The drilling system 100 includes a drill rig 103 used to turn a drilling tool assembly 104 which extends downward into the wellbore 102. The drilling tool assembly 104 may include a drill string 105, a bottomhole assembly ("BHA") 106, and a bit 110, attached to the downhole end of drill string 105.

The drill string 105 may include several joints of drill pipe 108 connected end-to-end through tool joints 109. The drill string 105 transmits drilling fluid through a central bore and transmits rotational power from the drill rig 103 to the BHA 106. In some embodiments, the drill string 105 may further include additional components such as subs, pup joints, etc. The drill pipe 108 provides a hydraulic passage through which drilling fluid is pumped from the surface. The drilling fluid discharges through selected-size nozzles, jets, or other orifices in the bit 110 for the purposes of cooling the bit 110 and cutting structures thereon, and for lifting cuttings out of the wellbore 102 as it is being drilled.

The BHA 106 may include the bit 110 or other components. An example BHA 106 may include additional or other components (e.g., coupled between to the drill string 105 and the bit 110). Examples of additional BHA components include drill collars, stabilizers, measurement-while-drilling ("MWD") tools, logging-while-drilling ("LWD") tools, downhole motors, underreamers, section mills, hydraulic disconnects, jars, vibration or dampening tools, other components, or combinations of the foregoing.

In general, the drilling system 100 may include other drilling components and accessories, such as special valves (e.g., kelly cocks, blowout preventers, and safety valves). Additional components included in the drilling system 100 may be considered a part of the drilling tool assembly 104, the drill string 105, or a part of the BHA 106 depending on their locations in the drilling system 100.

The bit 110 in the BHA 106 may be any type of bit suitable for degrading downhole materials. For instance, the bit 110 may be a drill bit suitable for drilling the earth formation 101. Example types of drill bits used for drilling earth formations are fixed-cutter or drag bits. In other embodiments, the bit 110 may be a mill used for removing metal, composite, elastomer, other materials downhole, or combinations thereof. For instance, the bit 110 may be used with a whipstock to mill into casing 107 lining the wellbore 102. The bit 110 may also be a junk mill used to mill away tools, plugs, cement, other materials within the wellbore 102, or combinations thereof. Swarf or other cuttings formed by use of a mill may be lifted to surface, or may be allowed to fall downhole.

Figure 2:
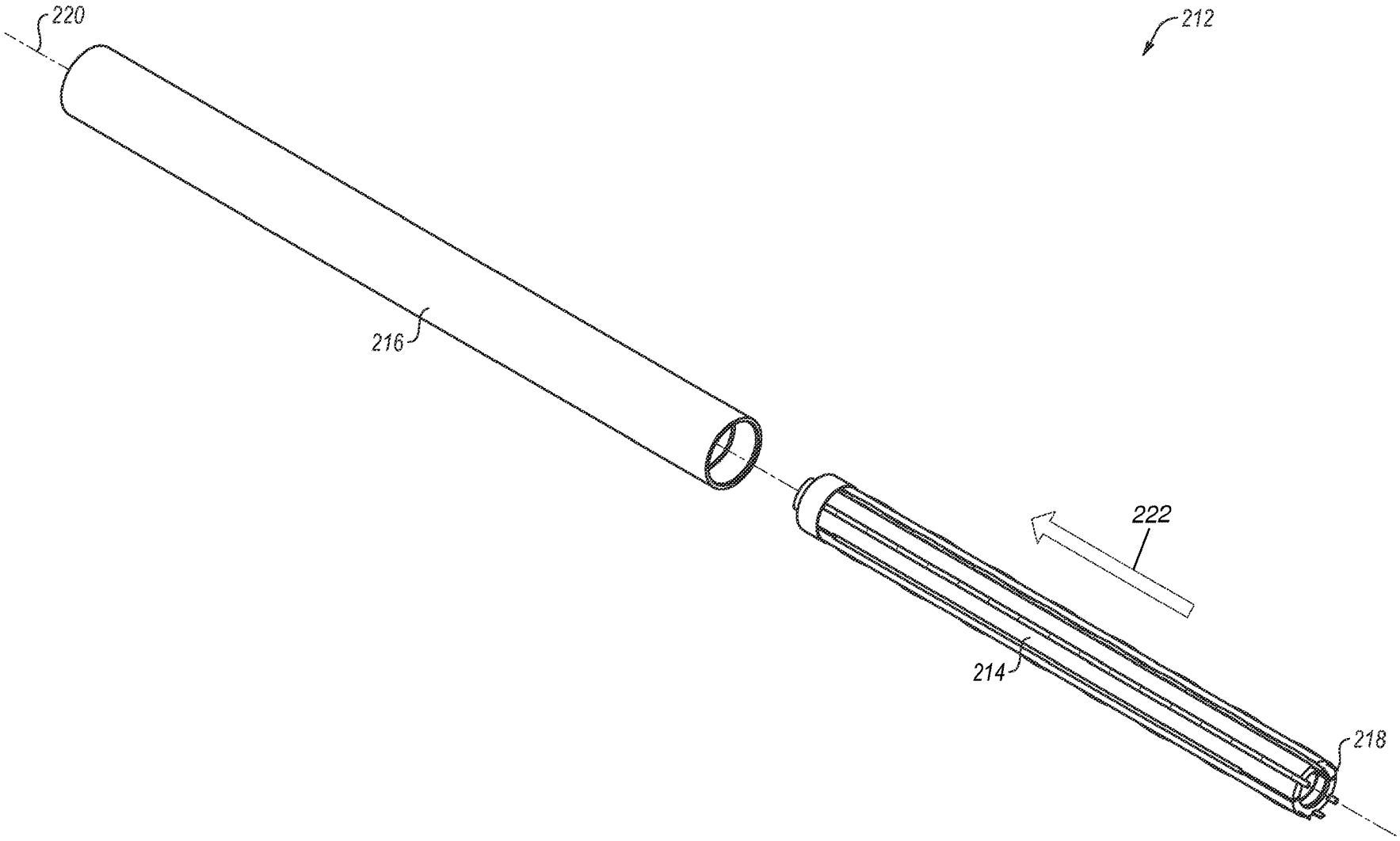
FIG. 2 is a partially exploded view of a representation of a downhole tool stabilization system, according to at least one embodiment of the present disclosure.

FIG. 2 is a partially exploded view of a representation of a downhole tool stabilization system 212, according to at least one embodiment of the present disclosure. A downhole tool is located inside a chassis 214. During operation, the chassis 214 is inserted into a bore of a housing 216. A plurality of linear wave springs 218 are located around an outer circumference of the chassis 214. The downhole tool stabilization system 212 includes three configurations. In the configuration shown, or the first configuration, the chassis 214 and the plurality of linear wave springs 218 are located outside of the housing 216. For example, during assembly of the downhole tool stabilization system 212, the chassis 214 may be assembled outside of the housing.

In a second configuration, the chassis 214 is inserted into the housing 216. To insert the chassis 214 into the housing, the chassis 214 and the housing 216 are placed along the same longitudinal axis 220. An insertion force 222, parallel to the longitudinal axis 220, is applied to the chassis 214 and/or the housing 216 to insert the chassis 214 into the housing 216. The insertion force 222 required to insert the chassis 214 into the housing 216 may be reduced by selecting linear wave springs 218 having a height that is less than or equal to the annular gap between the chassis 214 and the housing 216. This may reduce the time and effort required to install the chassis 214 in the housing 216.

Figures 1, 3:
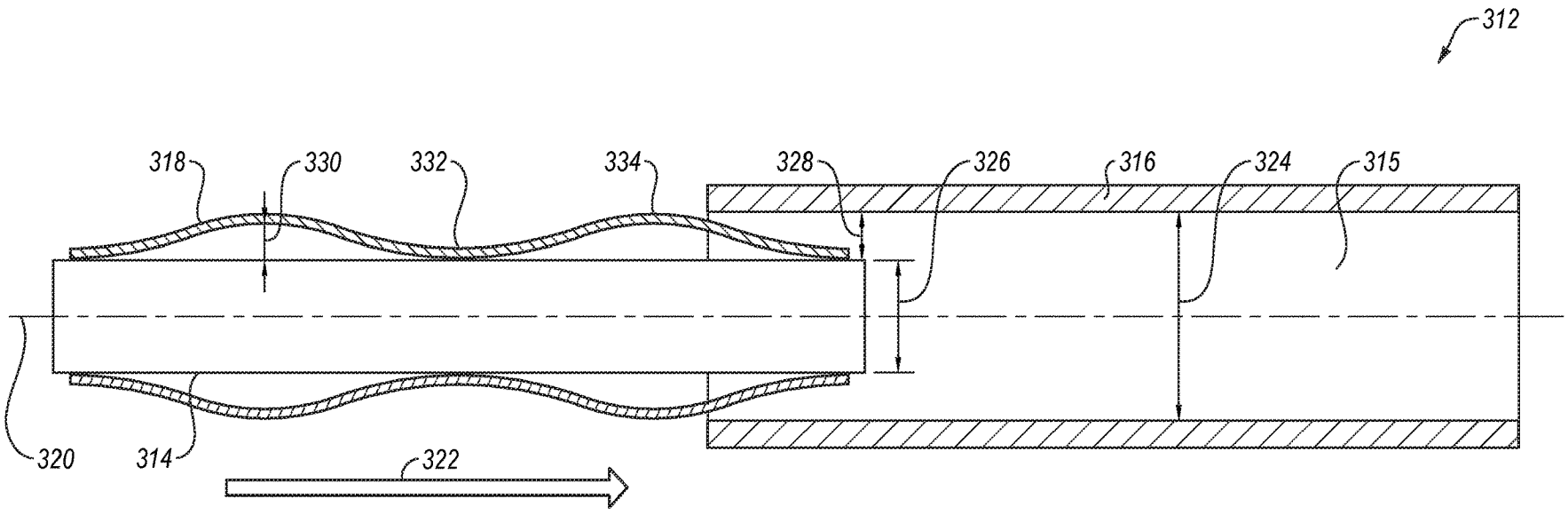
Figures 2, 3:
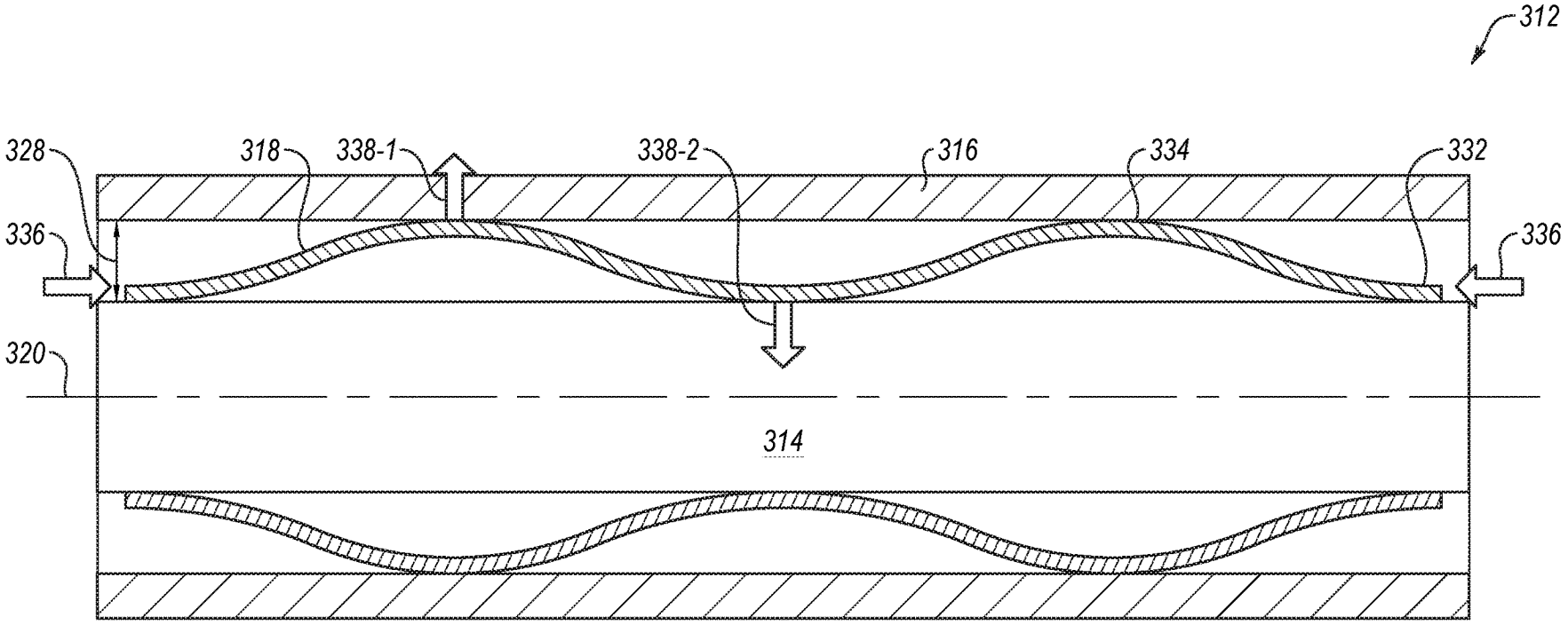

FIG. 3-1 is a schematic representation of a downhole tool stabilization system 312, according to at least one embodiment of the present disclosure. In the position shown, the chassis 314 is transitioning between the first configuration, where the chassis 314 is located outside of the housing 316, and the second configuration, where the chassis 314 is located inside a bore 315 of the housing 316. The housing 316 has a housing inner diameter 324 and the chassis 314 has a chassis outer diameter 326. A difference between the housing inner diameter 324 and the chassis outer diameter 326 is an annular space. Half of the annular space is the annular gap 328, which is the space between the outer surface of the chassis 314 and the inner surface of the housing 316.

The linear wave springs 318 have an unstressed height 330. The unstressed height 330 is the height of the linear wave spring 318 from a valley 332 to a peak 334 of the linear wave spring 318 when no tensile or compressive force is applied to the linear wave spring 318. In some embodiments, the unstressed height 330 is an unstressed height percentage of the annular gap 328. In some embodiments, the unstressed height percentage may be in a range having a lower value, an upper value, or lower and upper values including any of 50%, 75%, 80%, 85%, 90%, 92.5%, 95%, 97.5%, 98%, 99%, 100%, 100.5%, 101%, 101.5%, 102%, 103%, 104%, 105%, 110%, 115%, 120%, 130%, 140%, 150%, or any value therebetween. For example, the unstressed height percentage may be greater than 50%. In another example, the unstressed height percentage may be less than 150%. In yet other examples, the unstressed height percentage may be any value in a range between 50% and 150%. In some embodiments, it may be critical that the unstressed height percentage is 100% or less to enable smooth installation of the chassis into the housing.

As the chassis 314 is inserted into the housing 316, if the unstressed height 330 of the linear wave spring 318 is larger than the annular gap 328, then a large insertion force 322, parallel to the longitudinal axis 320, may be required to reduce the height of the linear wave spring 318. If, as in the embodiment shown, the unstressed height 330 of the linear wave spring is the same as or less than the annular gap 328, then a low insertion force 322 is required to insert the chassis 314 into the housing 316. A low insertion force 322 may make it easy to assemble the downhole tool stabilization system 312. This may allow an operator to disassemble and assemble the downhole tool stabilization system 312 in the field, thereby reducing time and money to assemble it off-site.

In some embodiments, the insertion force 322 may be in a range having a lower value, an upper value, or lower and upper values including any of 1 Newtons (N), 50 N, 100 N, 150 N, 200 N, 250 N, 300 N, 350 N, 400 N, 450 N, 500 N, 600 N, 700 N, 800 N, 900 N, 1,000 N, or any value therebetween. For example, the insertion force 322 may be greater than 1 N. In another example, the insertion force 322 may be less than 1,000 N. In yet other examples, the insertion force 322 may be any value in a range between 1 N and 1,000 N. In some examples the insertion force 322 may be the force required to move the combined mass of the chassis, the downhole tool, and the linear wave springs longitudinally into the housing. In some examples, the insertion force 322 may include the force required to move the combined mass plus any friction forces required to slide the chassis along the housing. In some examples, the insertion force 322 may not include the force required to radially compress one or more of the linear wave springs.

FIG. 3-2 is a schematic representation of the downhole tool stabilization system 312 of FIG. 3-1 in the second and third configurations, according to at least one embodiment of the present disclosure. In the second configuration, the chassis 314 is inserted into the housing 316. In the third configuration, a compressive force 336, parallel to the longitudinal axis 320, is applied to the linear wave springs 318. The compressive force 336 may cause an unconfined linear wave spring 318 to buckle, or for the distance between a peak 334 and a valley 332 to increase. In the confines of the annular gap 328 between the housing 316 and the chassis 314, the compressive force 336 will cause a radial force (collectively 338) to be applied to the housing 316 and the chassis 314.

The radial force 338 includes an outward radial force 338-1 against the housing and an inward radial force 338-2 against the chassis 314. The outward radial force 338-1 and the inward radial force 338-1 oppose each other to secure the chassis 314 to the housing 316. By applying the compressive force 336 to the linear wave spring 318, larger radial forces 338 may be applied to the housing 316. A larger radial force 338 may result in greater transmissibility of shock and vibration to the chassis 314, which may prevent vibration and movement of the chassis 314 relative to the housing 316, thereby preventing damage to the downhole tool located inside the chassis.

In some embodiments, the compressive force 336 applied to the linear wave spring 318 in the third configuration may be in a range having a lower value, an upper value, or lower and upper values including any of 1 kilonewtons (kN), 2 kN, 3 kN, 4 kN, 5 kN, 6 kN, 7 kN, 8 kN, 9 kN, 10 kN, 12 kN, 14 kN, 15 kN, 17.5 kN, 20 kN, or any value therebetween. For example, the compressive force 336 may be greater than 1 kN. In another example, the compressive force 336 may be less than 20 kN. In yet other examples, the compressive force 336 may be any value in a range between 1 kN and 20 kN. In some embodiments, it may be critical that the compressive force 336 is greater than 7 kN to ensure that a sufficient radial force 338 is applied to secure the chassis 314 to the housing 316.

Compressing the linear wave springs 318 results in an inward radial force 338-2 against the chassis 314 and an outward radial force 338-1 against the housing for each linear wave spring 318. In some embodiments, the magnitude of the radial force (collectively 338) may be in a range having a lower value, an upper value, or lower and upper values including any of 0.5 kN, 1.0 kN, 1.5 kN, 2.0 kN, 2.5 kN, 3.0 kN, 4.0 kN, 5.0 kN, 6.0 kN, 7.0 kN, 8.0 kN, 9.0 kN, 10 kN, 15 kN, 20 kN, or any value therebetween. For example, the radial force 338 may be greater than 0.5 kN. In another example, the radial force 338 may be less than 20 kN. In yet other examples, the radial force 338 may be any value in a range between 0.5 kN and 20 kN. In some embodiments, it may be critical that the radial force 338 is greater than 5 kN to properly secure the chassis and protect it from shock and vibration damage.

The plurality of linear wave springs 318 have a combined radial force 338 on the housing 316 and the chassis 314. This is the sum of the individual radial forces 338 applied by the plurality of linear wave springs 318. In some embodiments, the combined radial force 338 may be in a range including any of 1.0 kN, 2.0 kN, 2.5 kN, 5.0 kN, 6.0 kN, 7.0 kN, 8.0 kN, 9.0 kN, 10 kN, 15 kN, 20 kN, 30 kN, 40 kN, 50 kN, 75 kN, 100 kN, 150 kN, 200 kN, or any value therebetween. For example, the combined radial force 338 may be greater than 1.0 kN. In another example, the combined radial force 338 may be less than 200 kN. In yet other examples, the combined radial force 338 may be any value in a range between 1.0 kN and 200 kN. In some embodiments, it may be critical that the combined radial force 338 is greater than 10 kN to properly secure the chassis and protect it from shock and vibration damage.

The combined radial force 338 has a force ratio with the compressive force 336. In some embodiments, the force ratio may be in a range having a lower value, an upper value, or lower and upper values including any of 5:1, 4:1, 3:1, 2:1, 1:1, 1:2, 1:3, 1:4, 1:5, or any value therebetween. For example, the force ratio may be greater than 5:1. In another example, the force ratio may be less than 1:5. In yet other examples, the force ratio may be any value in a range between 5:1 and 1:5. In some embodiments it may be critical that the force ratio is greater than 3:1 to properly secure the chassis and protect it from shock and vibration damage.

Figures 1, 4:
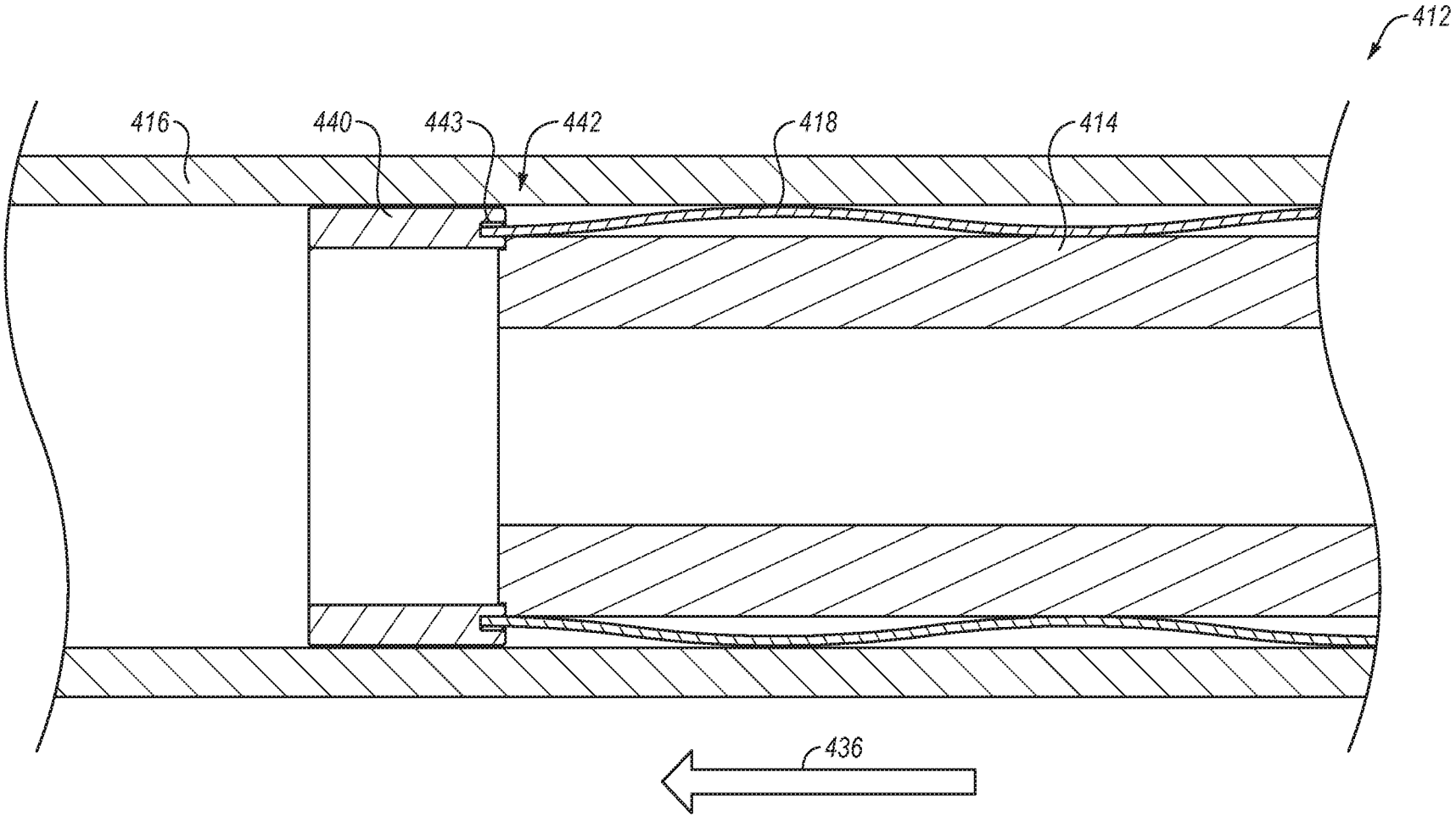
Figures 2, 4:
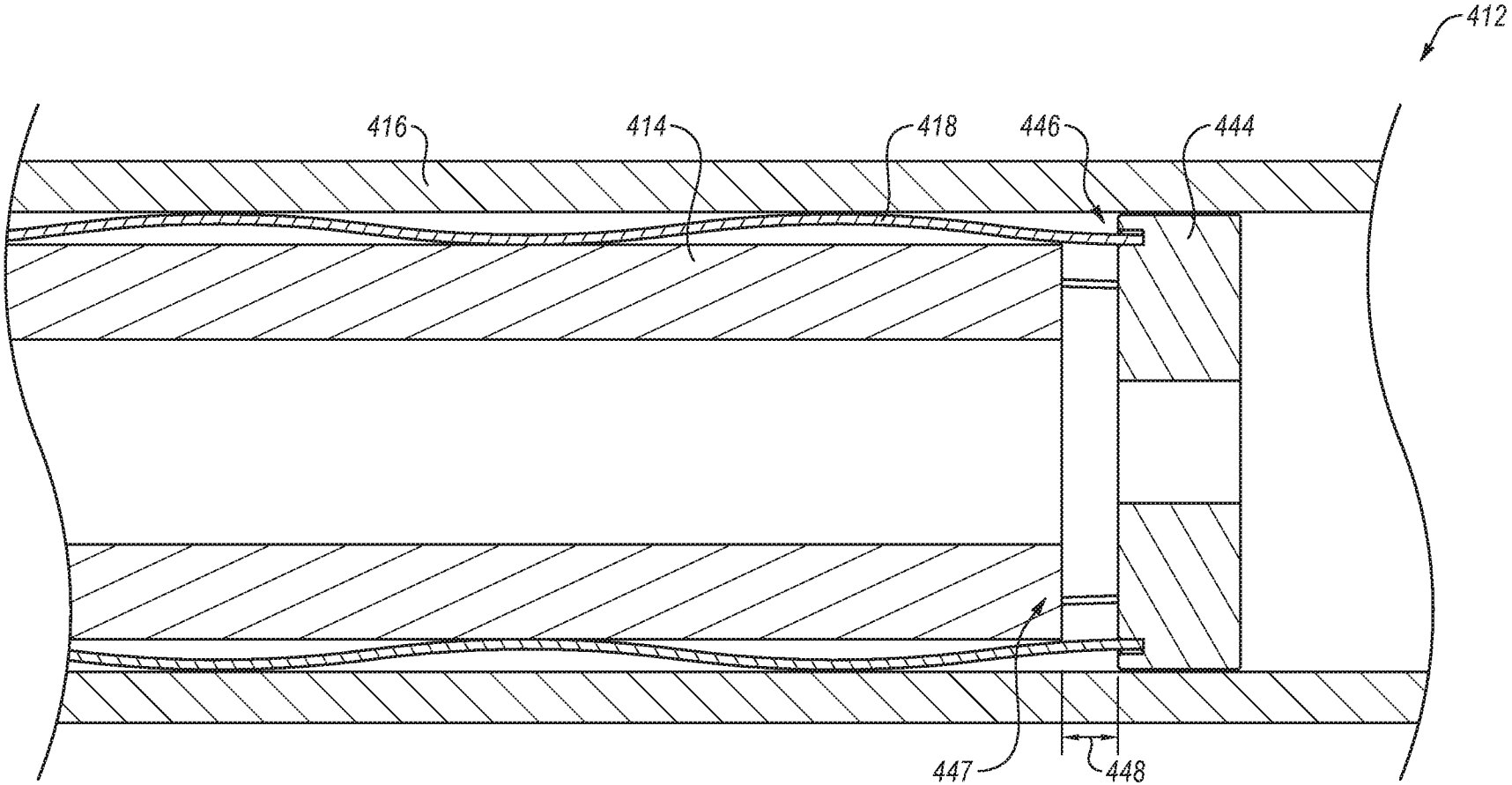
Figures 3, 4:
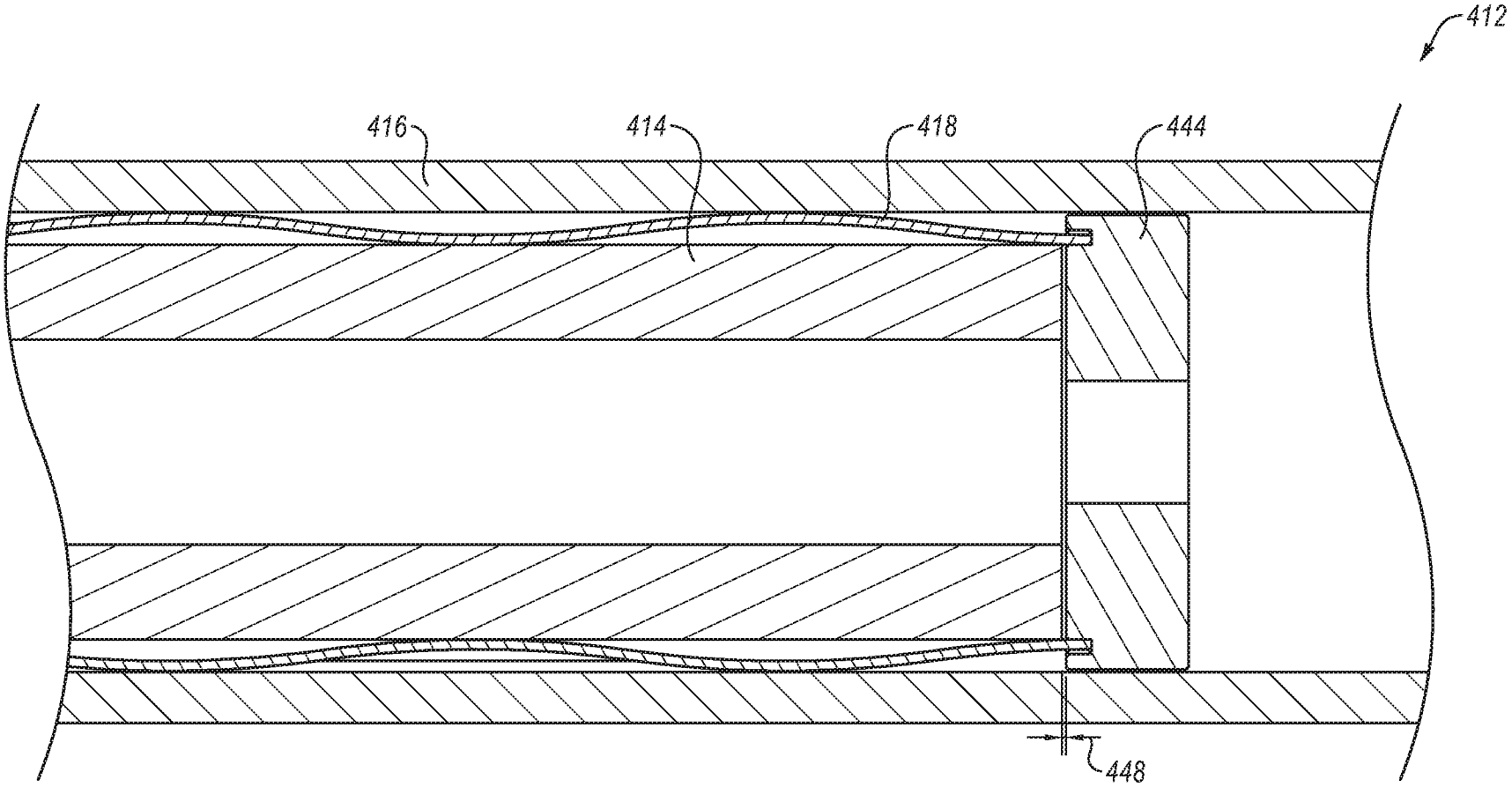

FIG. 4-1 is a cross-sectional view of a downhole tool stabilization system 412, according to at least one embodiment of the present disclosure. In the embodiment shown, the downhole tool stabilization system 412 is in the second and the third configuration. In other words, the chassis 414 is inserted into the housing 416. A plurality of linear wave springs 418 are connected to a support member 440 at a first end 442 of the plurality of linear wave springs 418. The support member 440 longitudinally secures the plurality of linear wave springs 418 to the housing 416. Thus, as a compressive force 436 is applied to the plurality of linear wave springs 418, the support member 440 prevents the plurality of linear wave springs 418 from longitudinal movement. This allows the plurality of linear wave springs 418 to be compressed in response to the compressive force and to therefore apply a radial force to the housing 416.

In the embodiment shown, the support member 440 is an annular ring longitudinally secured to the housing 416 with a threaded connection. The second end 446 of the linear wave springs 418 is inserted into a ring 443 in the end of the support member 440. In this manner, the second end 446 of the linear wave springs 418 may slide along the ring 443 as the support member 440 is threaded into the housing 416.

FIG. 4-2 is a cross-sectional view of the downhole stabilization system 412 of FIG. 4-1 in the second configuration, according to at least one embodiment of the present disclosure. A compression member 444 is connected to a second end 446 of the linear wave springs 418. In the view shown, the downhole stabilization system 412 is in the second configuration. In other words, the compression member 444 is not applying a compressive force to the linear wave springs 418. Because the support member 440 shown in FIG. 4-1 does not move (e.g., is fixed) relative to the housing 416, as the compression member 444 is moved toward the chassis 414, the linear wave springs 418 are compressed against the support member 440.

There is a compression gap 448 between the second end 447 of the chassis 414 and the bottom of the compression member 444. The compression gap 448 is the longitudinal distance that the linear wave springs 418 may be compressed. In other words, the unstressed length of the linear wave springs 418 (as indicated in FIG. 4-2) is longer than the stressed length of the linear wave springs 418 (as indicated in FIG. 4-3). As the compression member 444 moves toward the chassis 414, the length of the linear wave springs 418 is reduced, thereby applying a compressive force to the linear wave springs.

FIG. 4-3 is a cross-sectional view of the downhole stabilization system 412 of FIG. 4-1 in the third configuration, according to at least one embodiment of the present disclosure. In the position shown, the compression member 444 has been moved toward the chassis 414. This has closed the compression gap 448 so that the compression member 444 contacts the chassis 414. By closing the compression gap 448, the linear wave springs 418 have been reduced in length. In the embodiment shown, the compression member 444 is threaded into the housing 416. By rotating the compression member 444 in the threads of the housing 416, the compression member 444 may move toward the chassis 414, thereby compressing the linear wave springs 418.

In some embodiments, the length of the linear wave spring 418 may be decreased by a length reduction. In some embodiments, the length reduction may be in a range having a lower value, an upper value, or lower and upper values including any of 0.5 millimeters (mm), 1.0 mm, 1.5 mm, 2.0 mm, 2.5 mm, 3.0 mm, 3.5 mm, 4 mm, 5 mm, 6 mm, 7 mm, 8 mm, 9 mm, 10 mm, or any value therebetween. For example, the length reduction may be greater than 0.5 mm. In another example, the length reduction may be less than 10 mm. In yet other examples, the length reduction may be any value in a range between 0.5 mm and 10 mm. In some embodiments, it may be critical that the length reduction is greater than 2 mm to ensure a sufficient radial force between the housing and the chassis.

The length of the linear wave spring 418 may be reduced by a length reduction percentage when compressed by the compression member, which is a percentage of the length reduction relative based on the linear wave spring length. In some embodiments, the length reduction percentage may be in a range having a lower value, an upper value, or lower and upper values including any of 0.5%, 1%, 2%, 3%, 4%, 5%, 6%, 7%, 8%, 9%, 10%, 15%, 20%, or any value therebetween. For example, the length reduction percentage may be greater than 0.5%. In another example, the length reduction percentage may be less than 20%. In yet other examples, the length reduction percentage may be any value in a range between 0.5% and 20%. In some embodiments, it may be critical that the length reduction percentage is greater than 5% to ensure a sufficient radial force between the housing and the chassis.

Figure 5:
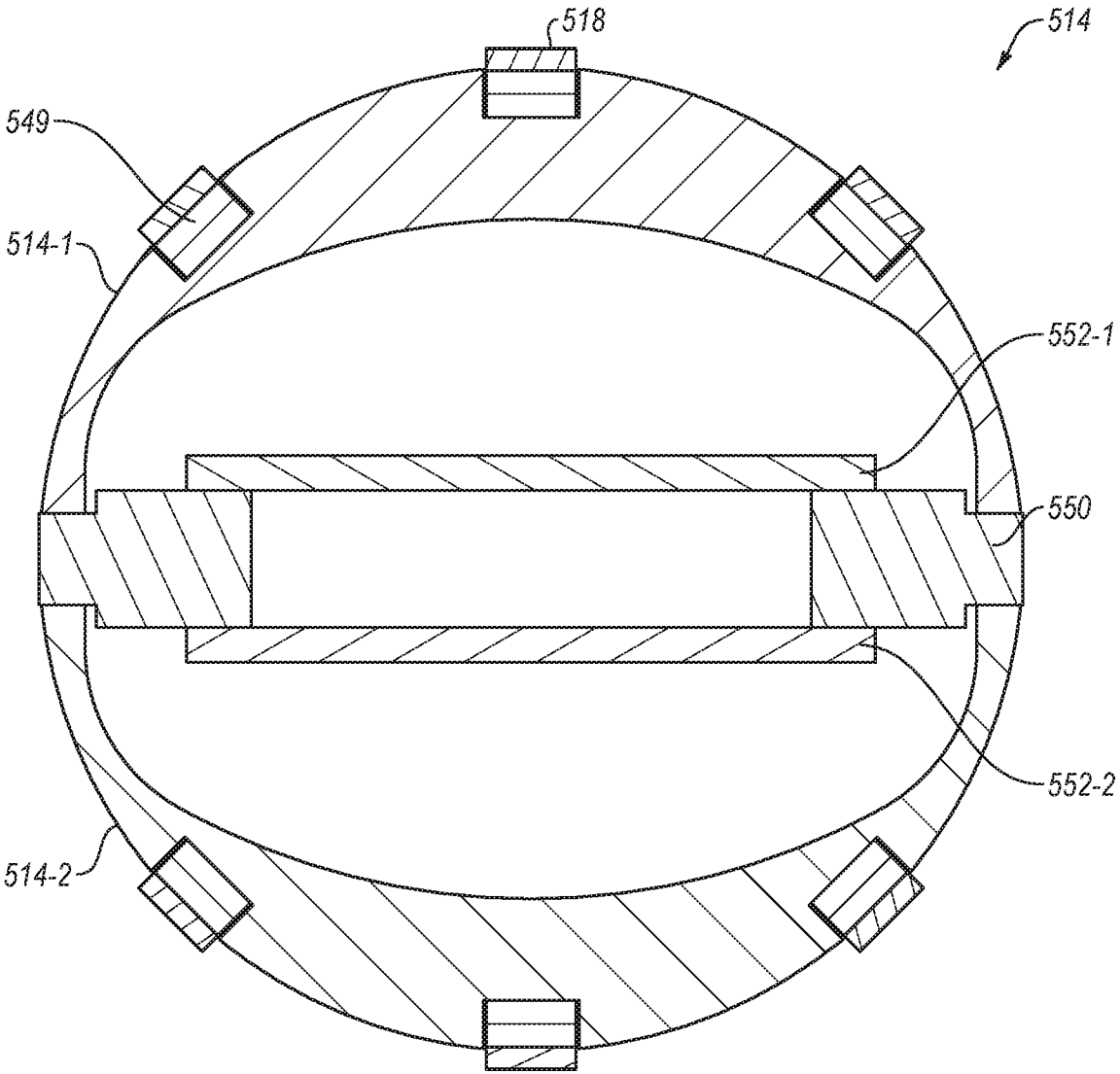
FIG. 5 is a cross-sectional view of a downhole tool stabilization system, according to at least one embodiment of the present disclosure.

FIG. 5 is a transverse cross-section of a chassis 514, according to at least one embodiment of the present disclosure. In the embodiment shown, the chassis 514 includes a first chassis portion 514-1 and a second chassis portion 514-2. Six linear wave springs 518 are arranged around the chassis 514. In the embodiment shown, the linear wave springs are placed equally spaced around the first chassis portion 514-1 and the second chassis portion 514-2. Each linear wave spring is located in a wave spring slot 549 in the outer surface of the chassis 514. Sandwiched between the first chassis portion 514-1 and the second chassis portion 514-2 is a downhole tool support member 550. The downhole tool support member 550 supports a first electronics board 552-1 and a second electronics board 552-2.

When the linear wave springs 518 are placed into the stressed state (e.g., when the linear wave springs 518 are compressed), the linear wave springs 518 may cause the first chassis portion 514-1 and the second chassis portion 514-2 to push against the housing into each other, thereby placing the downhole tool support member 550 in compression. This may secure the downhole tool support member 550, and the attached electronics boards 552-1, 552-2, to the chassis 514. The increased radial forces possible from compressing the linear wave springs 518 may more securely connect the downhole tool support member and the electronics boards 552-1, 552-2 to the chassis 514, which may improve performance of the electronics boards 552-1, 552-2.

Figure 6:
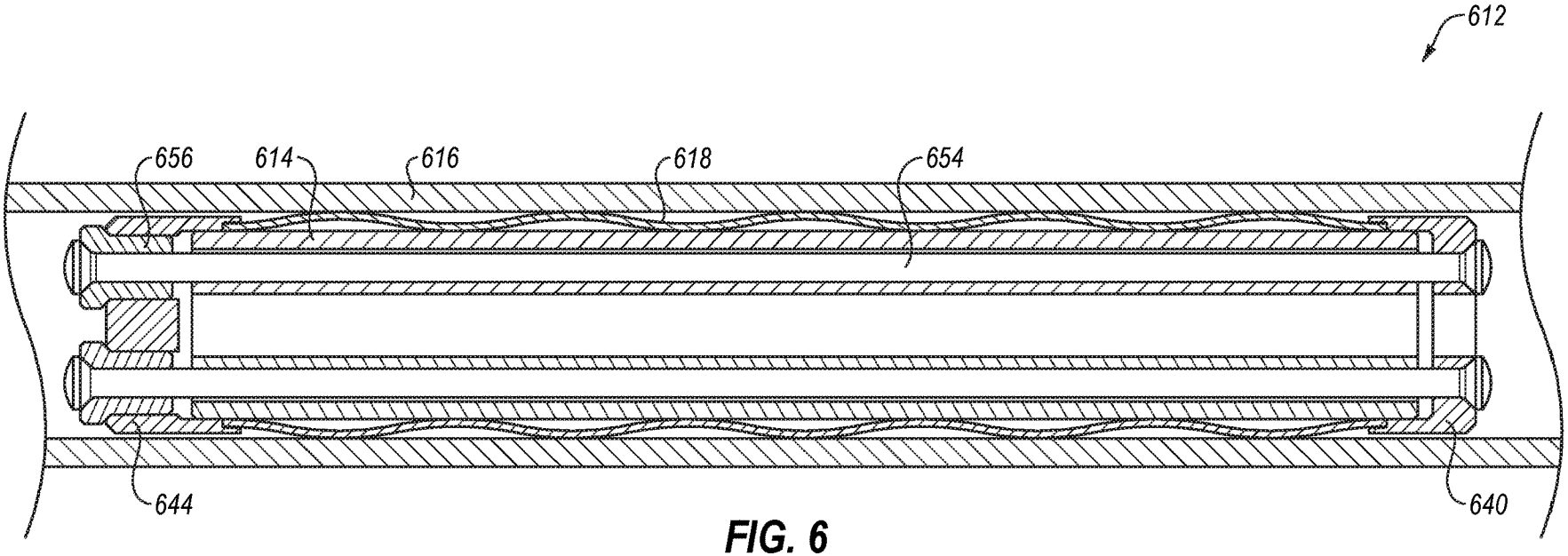
FIG. 6 is a cross-sectional view of another downhole tool stabilization system, according to at least one embodiment of the present disclosure.

FIG. 6 is a cross-sectional view of a representation of a downhole tool support system 612, according to at least one embodiment of the present disclosure. In the embodiment shown, a plurality of compression bars 654 extend the length of a chassis 614. A plurality of linear wave springs 618 are connected to a support member 640 and a compression member 644. The compression member 644 includes one or more plates 656, through which the compression bars 654 extend.

The compression bars 654 are made from a shape-memory alloy. Thus, the compression bars 654 have a first shape and/or length at a cold temperature and a second shape and/or length at a hot temperature. The second length is longer than the first length. Thus, if the downhole tool support system 612 is assembled at the hot temperature, when the downhole tool support system 612 is reduced to the cold temperature, the compression bars 654 may reduce in length, thereby applying a compressive force between the support member 640 and the compression member 644. The compression member 644 and the support member 640 may transfer this compressive force to the linear wave springs 618, which may cause the linear wave springs 618 to reduce in length and apply a radial force against the chassis 614 and the housing 616.

Figure 7:
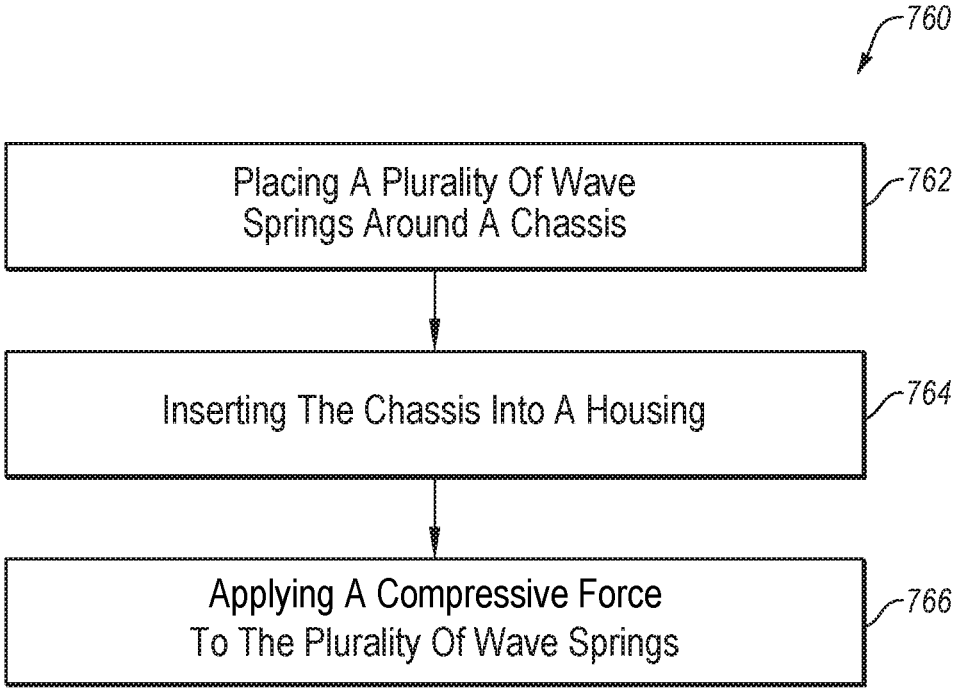
FIG. 7 is a representation of a method for stabilizing a downhole tool, according to at least one embodiment of the present disclosure.

FIG. 7 is a representation of a method 760 for securing a downhole tool, according to at least one embodiment of the present disclosure. The method 760 includes placing a plurality of wave springs around a chassis at 762. The chassis may be inserted into the housing at 764. Inserting the chassis into the housing may include inserting the chassis with an insertion force. In some embodiments, the insertion force may be in a range having a lower value, an upper value, or lower and upper values including any of 1 Newtons (N), 50 N, 100 N, 150 N, 200 N, 250 N, 300 N, 350 N, 400 N, 450 N, 500 N, 600 N, 700 N, 800 N, 900 N, 1,000 N, or any value therebetween. For example, the insertion force may be greater than 1 N. In another example, the insertion force may be less than 1,000 N. In yet other examples, the insertion force may be any value in a range between 1 N and 1,000 N. In some examples the insertion force may be the force required to move the combined mass of the chassis, the downhole tool, and the linear wave springs longitudinally into the housing. In some examples, the insertion force may include the force required to move the combined mass plus any friction forces required to slide the chassis along the housing. In some examples, the insertion force may not include the force required to radially compress one or more of the linear wave springs.

A compressive force may be applied on the plurality of wave springs at 766. The compressive force may be parallel to the longitudinal axis of the housing. Applying the compressive force may include causing the plurality of wave springs to apply a radial force to the housing. Furthermore, applying the compressive force may include threading a compression member into the housing. In some embodiments, applying the compressive force may include reducing the length of the plurality of wave springs by at least 3 mm.

The embodiments of the system for securing a downhole tool have been primarily described with reference to wellbore drilling operations; the system for securing a downhole tool described herein may be used in applications other than the drilling of a wellbore. In other embodiments, system for securing a downhole tool according to the present disclosure may be used outside a wellbore or may be used in other downhole environments used for the exploration or production of natural resources. For instance, system for securing a downhole tool of the present disclosure may be used in a borehole used for placement of utility lines or may be used downhole in a production system. Accordingly, the terms "wellbore," "borehole" and the like should not be interpreted to limit tools, systems, assemblies, or methods of the present disclosure to any particular industry, field, or environment.

One or more specific embodiments of the present disclosure are described herein. These described embodiments are examples of the presently disclosed techniques. Additionally, in an effort to provide a concise description of these embodiments, not all features of an actual embodiment may be described in the specification. It should be appreciated that in the development of any such actual implementation, as in any engineering or design project, numerous embodiment-specific decisions will be made to achieve the developers' specific goals, such as compliance with system-related and business-related constraints, which may vary from one embodiment to another. Moreover, it should be appreciated that such a development effort might be complex and time consuming, but would nevertheless be a routine undertaking of design, fabrication, and manufacture for those of ordinary skill having the benefit of this disclosure.

Additionally, it should be understood that references to "one embodiment" or "an embodiment" of the present disclosure are not intended to be interpreted as excluding the existence of additional embodiments that also incorporate the recited features. For example, any element described in relation to an embodiment herein may be combinable with any element of any other embodiment described herein. Numbers, percentages, ratios, or other values stated herein are intended to include that value, and also other values that are "about" or "approximately" the stated value, as would be appreciated by one of ordinary skill in the art encompassed by embodiments of the present disclosure. A stated value should therefore be interpreted broadly enough to encompass values that are at least close enough to the stated value to perform a desired function or achieve a desired result. The stated values include at least the variation to be expected in a suitable manufacturing or production process, and may include values that are within 5%, within 1%, within 0.1%, or within 0.01% of a stated value.

A person having ordinary skill in the art should realize in view of the present disclosure that equivalent constructions do not depart from the spirit and scope of the present disclosure, and that various changes, substitutions, and alterations may be made to embodiments disclosed herein without departing from the spirit and scope of the present disclosure. Equivalent constructions, including functional "means-plus-function" clauses are intended to cover the structures described herein as performing the recited function, including both structural equivalents that operate in the same manner, and equivalent structures that provide the same function. It is the express intention of the applicant not to invoke means-plus-function or other functional claiming for any claim except for those in which the words 'means for' appear together with an associated function. Each addition, deletion, and modification to the embodiments that falls within the meaning and scope of the claims is to be embraced by the claims.

The terms "approximately," "about," and "substantially" as used herein represent an amount close to the stated amount that is within standard manufacturing or process tolerances, or which still performs a desired function or achieves a desired result. For example, the terms "approximately," "about," and "substantially" may refer to an amount that is within less than 5% of, within less than 1% of, within less than 0.1% of, and within less than 0.01% of a stated amount. Further, it should be understood that any directions or reference frames in the preceding description are merely relative directions or movements. For example, any references to "up" and "down" or "above" or "below" are merely descriptive of the relative position or movement of the related elements.

The present disclosure may be embodied in other specific forms without departing from its spirit or characteristics. The described embodiments are to be considered as illustrative and not restrictive. The scope of the disclosure is, therefore, indicated by the appended claims rather than by the foregoing description. Changes that come within the meaning and range of equivalency of the claims are to be embraced within their scope.

What is claimed is:

1. A system for stabilizing a downhole tool, comprising:
a housing having a bore therethrough;
a chassis;
a plurality of linear wave springs arranged around an outer circumference of the chassis, the plurality of linear wave springs being supported on a first end by a support member;
a first configuration wherein the chassis and the plurality of linear wave springs are located outside of the housing;
a second configuration wherein the chassis and the plurality of linear wave springs are inserted into the housing; and
a third configuration wherein a compression member at a second end of the plurality of linear wave springs applies a compressive force to the plurality of linear wave springs, and the plurality of linear wave springs applies a radial force against the housing in the third configuration, such that a force ratio of the compressive force to the radial force is approximately 1.

2. The system of claim 1, a first length of the plurality of linear wave springs in the first configuration being the same as a second length of the plurality of linear wave springs in the second configuration.

3. The system of claim 1, a first height of the plurality of linear wave springs in the first configuration being the same as a second height of the plurality of linear wave springs in the second configuration.

4. The system of claim 1, the chassis including a first chassis portion and a second chassis portion, and wherein in the third configuration, the first chassis portion is compressed against the second chassis portion by a combined inward radial force from the plurality of linear wave springs.

5. The system of claim 1, the support member being threaded into the housing.

6. The system of claim 1, the compression member being threaded into the housing.

7. The system of claim 1, the compression member applying 12 kilonewtons (kN) of compressive force against the plurality of linear wave springs in the third configuration.

8. The system of claim 1, the housing being non-cylindrical.

9. The system of claim 1, the compression member including a plate in the bore of the housing, a rod extending between the plate and the support member, the rod applying a compressive force between the compression member and the support member.

10. A method for securing a downhole tool, comprising:
placing a plurality of linear wave springs around a chassis;
inserting the chassis into a housing;
inserting the plurality of linear wave springs into the housing; and
after inserting the chassis and the plurality of linear wave springs into the housing, applying a compressive force on the plurality of linear wave springs, the compressive force being parallel to a longitudinal axis of the housing, wherein applying the compressive force includes threading a compression member into the housing.

11. The method of claim 10, wherein applying the compressive force further includes causing the plurality of linear wave springs to apply a radial force to the housing.

12. The method of claim 10, wherein inserting the chassis into the housing includes inserting the chassis with a force of between 0 and 250 N.

13. The method of claim 10, wherein applying the compressive force further includes reducing a length of the plurality of linear wave springs by at least 3 mm.

14. A system for stabilizing a downhole tool, comprising:
a housing having a bore therethrough;

a chassis;

a plurality of linear wave springs arranged around an outer circumference of the chassis, the plurality of linear wave springs being supported on a first end by a support member;

a first configuration wherein the chassis and the plurality of linear wave springs are located outside of the housing;

a second configuration wherein the chassis and the plurality of linear wave springs are inserted into the housing; and a third configuration wherein a compression member at a second end of the plurality of linear wave springs applies a compressive force to the plurality of linear wave springs, and wherein the compression member is threaded into the housing.

15. The system of claim 14, the support member being threaded into the housing.

16. The system of claim 14, the compression member applying 12 kilonewtons (kN) of compressive force against the plurality of linear wave springs in the third configuration.

17. The system of claim 14, the housing being non-cylindrical.

18. The system of claim 14, a first length of the plurality of linear wave springs in the first configuration being the same as a second length of the plurality of linear wave springs in the second configuration.

19. The system of claim 14, a first height of the plurality of linear wave springs in the first configuration being the same as a second height of the plurality of linear wave springs in the second configuration.

* * * * *